US011441351B2

(12) United States Patent
Nüsser et al.

(10) Patent No.: US 11,441,351 B2
(45) Date of Patent: Sep. 13, 2022

(54) INSULATING GLAZING AND METHOD FOR PRODUCING SAME

(71) Applicant: SAINT-GOBAIN GLASS FRANCE, Courbevoie (FR)

(72) Inventors: Dirk Nüsser, Übach-Palenberg (DE); Florian Carre, Aachen (DE); Walter Schreiber, Aachen (DE)

(73) Assignee: SAINT-GOBAIN GLASS FRANCE, Courbevoie (FR)

( * ) Notice: Subject to any disclaimer, the term of this patent is extended or adjusted under 35 U.S.C. 154(b) by 193 days.

(21) Appl. No.: 16/962,467

(22) PCT Filed: Dec. 20, 2018

(86) PCT No.: PCT/EP2018/086191
§ 371 (c)(1),
(2) Date: Jul. 15, 2020

(87) PCT Pub. No.: WO2019/141484
PCT Pub. Date: Jul. 25, 2019

(65) Prior Publication Data

US 2021/0071466 A1 Mar. 11, 2021

(30) Foreign Application Priority Data

Jan. 16, 2018 (EP) ..... 18151865

(51) Int. Cl.
*E06B 3/663* (2006.01)
*E06B 3/667* (2006.01)
*E06B 3/677* (2006.01)

(52) U.S. Cl.
CPC ..... *E06B 3/677* (2013.01); *E06B 3/66342* (2013.01); *E06B 2003/6638* (2013.01)

(58) Field of Classification Search
CPC .... E06B 3/6612; E06B 3/663; E06B 3/66304; E06B 3/66314; E06B 3/66319;
(Continued)

(56) References Cited

U.S. PATENT DOCUMENTS 2,880,475 A * 4/1959 Mills ..... E06B 3/677 29/520
4,065,894 A * 1/1978 Day ..... E06B 3/984 52/171.3
(Continued)

FOREIGN PATENT DOCUMENTS

AT 327 423 B 1/1976
DE 38 08 907 A1 10/1989
(Continued)

OTHER PUBLICATIONS

International Search Report as issued in International Patent Application No. PCT/EP2018/086191, dated Feb. 15, 2019.
(Continued)

*Primary Examiner* — Kyle J. Walraed-Sullivan
(74) *Attorney, Agent, or Firm* — Pillsbury Winthrop Shaw Pittman LLP

(57) ABSTRACT

An insulating glazing includes a first a second pane, a spacer between the first and second pane that is fixedly connected to the first and second pane in a water-vapor-tight manner in each case, which spacer has two parallel pane contact walls, an outer wall, and a glazing interior wall and an interior, and a water-tight sealant strip running around the outer wall between the first and second pane. A pressure-equalizing element is inserted into the sealant strip and the spacer, which pressure-equalizing element is open to the surrounding atmosphere and to the interior of the spacer or to the glazing interior between the first and the second pane and is implemented such that it provides a gas connection having a pressure-equalizing function between the atmosphere and
(Continued)

Figure 1:
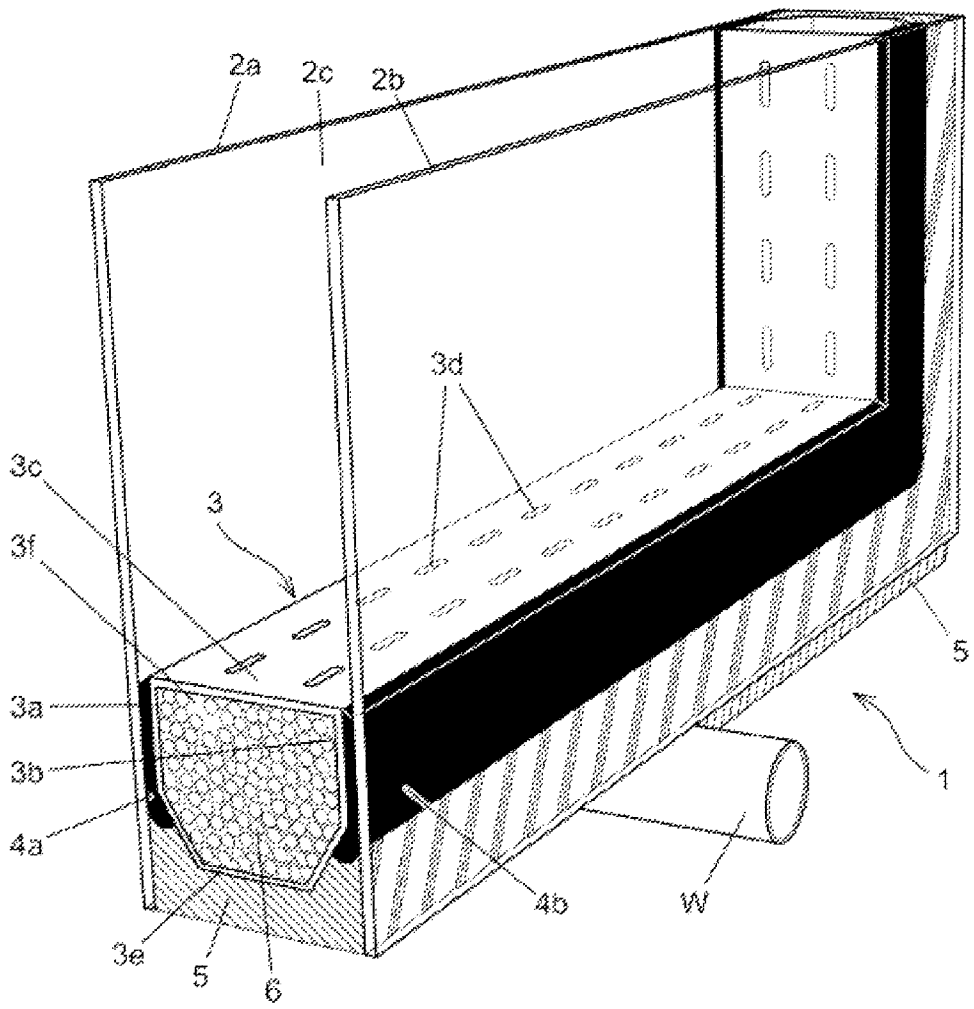
PRIOR ART Fig. 1

the interior of the spacer or the glazing interior which gas connection is temporally limited due to aging and/or atmospheric influences.

15 Claims, 5 Drawing Sheets

(58) Field of Classification Search
CPC ..... E06B 3/66328; E06B 3/66342; E06B 3/66352; E06B 3/67326; E06B 3/677; E06B 3/6775; E06B 2003/7094
See application file for complete search history.

(56) References Cited

U.S. PATENT DOCUMENTS 4,222,213 A * 9/1980 Kessler ..... E06B 3/66314 52/786.13
4,627,206 A * 12/1986 Cox ..... E06B 3/677 454/243
4,819,405 A * 4/1989 Jackson ..... E06B 3/677 52/235
4,952,430 A * 8/1990 Bowser ..... E06B 3/677 52/786.13
5,260,112 A * 11/1993 Grether ..... E06B 3/66319 52/786.13
5,394,671 A * 3/1995 Taylor ..... E06B 3/66323 52/786.13
5,460,862 A * 10/1995 Roller ..... E06B 3/66319 428/35.8
5,461,840 A * 10/1995 Taylor ..... E06B 3/66323 52/786.13
5,873,203 A * 2/1999 Thiel ..... E06B 3/677 52/786.13
5,878,538 A * 3/1999 Rossini ..... E06B 3/677 52/786.13
5,962,090 A * 10/1999 Trautz ..... E06B 3/66319 428/35.8
6,061,994 A * 5/2000 Goer ..... E06B 3/66319 52/843
6,389,779 B1 * 5/2002 Brunnhofer ..... E06B 3/66319 52/786.13
6,553,728 B1 * 4/2003 Zurn ..... E06B 3/677 52/204.52
7,757,455 B2 * 7/2010 Gallagher ..... E06B 3/67308 52/204.705
8,257,805 B2 * 9/2012 Landon ..... E06B 3/66328 52/786.13
8,898,973 B2 * 12/2014 Miller ..... E06B 3/677 52/302.3
2003/0074859 A1 * 4/2003 Reichert ..... E06B 3/66323 52/786.13
2005/0028460 A1 * 2/2005 Steffek ..... E06B 3/24 52/204.5
2005/0034386 A1 * 2/2005 Crandell ..... E06B 3/677 52/204.5
2005/0144863 A1 * 7/2005 Collins ..... E06B 3/677 52/204.5
2007/0033887 A1 * 2/2007 Ambrose ..... E06B 3/677 52/171.3
2008/0104900 A1 * 5/2008 Joasil ..... E06B 7/02 52/171.3
2009/0205743 A1 * 8/2009 Vianello ..... E06B 3/6775 141/4
2010/0098888 A1 * 4/2010 Landon ..... C03C 27/10 428/34
2012/0297708 A1 * 11/2012 Brunnhofer ..... E06B 3/66319 52/309.1
2013/0316184 A1 * 11/2013 Siodla ..... E06B 3/66323 428/34
2014/0260010 A1 * 9/2014 Waddell ..... E06B 3/677 29/428
2015/0322708 A1 * 11/2015 Kotowski ..... E06B 3/66304 52/745.16
2016/0001524 A1 * 1/2016 Abe ..... E06B 3/6612 428/33
2016/0060948 A1 * 3/2016 Burrows ..... C03C 17/3644 428/34
2016/0290032 A1 * 10/2016 Kuster ..... E06B 3/66319
2017/0152701 A1 * 6/2017 Kuster ..... E06B 3/67339
2017/0247935 A1 * 8/2017 Dobrovolny ..... E06B 3/66314
2017/0298680 A1 * 10/2017 Schreiber ..... E06B 3/66314
2017/0321472 A1 * 11/2017 Frank ..... E06B 3/66366
2017/0328121 A1 * 11/2017 Purdy ..... E06B 3/677
2018/0038151 A1 * 2/2018 Clarahan ..... E06B 7/02
2018/0058139 A1 * 3/2018 Schwerdt ..... E06B 3/66319
2018/0195339 A1 * 7/2018 Kuster ..... E06B 3/6675
2018/0344053 A1 * 12/2018 Schreiber ..... E06B 3/66371
2019/0291387 A1 * 9/2019 Neander ..... E06B 3/663
2021/0079716 A1 * 3/2021 Neander ..... E06B 3/6722
2021/0172242 A1 * 6/2021 Schreiber ..... E06B 3/67
2021/0246714 A1 * 8/2021 Neander ..... E06B 3/66366
2021/0285278 A1 * 9/2021 Kuster ..... E06B 9/264
2022/0034152 A1 * 2/2022 Kuster ..... E06B 3/66314

FOREIGN PATENT DOCUMENTS

DE 38 42 129 A1 6/1990
DE 195 06 119 A1 8/1996
DE 10 2005 002285 A1 7/2006
DE 20 2005 022110 U1 3/2014
EP 0 261 923 A2 3/1988
EP 2 006 481 A2 12/2008
FR 2 552 153 A1 3/1985
JP S45-003547 B 2/1970
JP S62-063796 A 3/1987
JP H04-189997 A 7/1992
JP H06-26282 A 2/1994
JP 2012-101987 A 5/2012
JP 2014-527502 A 10/2014
JP 2015-102132 A 6/2015
JP 2016-506465 A 3/2016
WO WO 2014/095097 A1 6/2014

OTHER PUBLICATIONS

Notice of Reasons for Rejection as issued in Japanese Patent Application No. 2020-538969, dated Aug. 31, 2021.

* cited by examiner

INSULATING GLAZING AND METHOD FOR PRODUCING SAME

CROSS-REFERENCE TO RELATED APPLICATIONS

This application is the U.S. National Stage of PCT/EP2018/086191, filed Dec. 20, 2018, which in turn claims priority to European patent application number 18 151 865.5 filed Jan. 16, 2018. The content of these applications are incorporated herein by reference in their entireties.

The invention relates to an insulating glazing that comprises a first pane and a second pane, a circumferential spacer between the first pane and the second pane that is fixedly connected to the first and second pane in a water-vapor-tight manner in each case, which spacer has at least two parallel pane contact walls, an outer wall, and a glazing interior wall as well as an interior, and a water-tight sealant strip running around the outer wall of the spacer between the first and second pane, wherein at least one pressure-equalizing element is inserted into the sealant strip and the spacer. It further relates to a method for producing such an insulating glazing as well as use thereof.

For decades, insulating glazings have been an indispensable component of residential and functional buildings in industrialized countries, especially in temperate and colder climate zones. In the course of worldwide efforts for climate protection and for saving heating and air-conditioning costs, they are becoming increasingly more important and are increasingly being used even in less developed countries.

Builders choose insulating glazing not only for its thermal insulation properties and cost but also largely for optical quality. Visible optical defects, such as those caused by glass surfaces that are not completely flat, are less and less acceptable to builders and their architects and virtually must not appear in marketable insulating glazings.

Insulating glazings are mass-produced in a few large factories of the individual manufacturers, and the finished insulating glazings are then delivered to many locations for further processing into components (windows, doors, etc.) or for direct construction-site use (for instance, for façade glazings or roof glazings). These can be at altitudes significantly different from the manufacturing site such that in the case of a hermetically sealed insulating glazing, as a result of the changed pressure at the site of further processing or use, bending of the panes can occur and can have a noticeable adverse effect on the optical quality of the insulating glazing. The stresses caused by the pressure differences also stress the edge seal of the insulating glazing and tend to lead to reliability problems.

Consequently, there is a need for a solution that enables pressure equalization between the atmosphere and the glazing interior before or during further processing or construction-site use of a finished insulating glazing.

Known in the prior art are various designs of insulating glazings in which a certain gas exchange between the glazing interior and the surroundings is enabled.

EP 0 261 923 A2 discloses a multi-pane insulating glazing with a spacer made of a moisture-permeable foam with an integrated desiccant. The assembly is preferably sealed by an external seal and a gas- and moisture-tight film. The film can contain metal-coated PET and polyvinylidene chloride copolymers.

DE 38 08 907 A1 discloses a multiple glass pane with a ventilation channel running through the edge seal and a desiccant-filled drying chamber.

DE 10 2005 002 285 A1 discloses an insulating glazing pressure-equalization system for use in the interpane space of thermal insulating glazings.

EP 2 006 481 A2 discloses a device for pressure equalization for insulating glazing units with an enclosed gas volume, wherein a pressure-equalization valve is inserted in the spacer of the insulating glazing. However, these pressure-equalization valves have a complicated mechanism in the form of multiple movable parts that not only cause increased susceptibility to error but also cause significantly higher production costs.

WO 2014/095097 A1 of the applicant describes an insulating glazing with a pressure-equalizing element and a method for its production. In that case, a pressure-equalizing body that contains a gas-permeable and vapor-diffusion-tight membrane is arranged in the sealing compound and protrudes into the outer wall of the spacer, and the circumferential spacer is divided by a special partition wall.

Known from DE 195 06 119 A1 is an insulating glazing according to the generic portion of claim 1, which specifically includes a pressure-equalizing element that provides a temporally limited connection between the interior of the insulating glazing and the atmosphere based on a measurement of the pressure of the surrounding atmosphere. From DE 38 42 129 A1 as well, a pressure-equalizing device for insulating glass panes is known that responds to the pressure difference between the interpane space and the atmosphere, temporarily opening a valve connecting the interpane space to the atmosphere.

The object of the invention is to indicate a simple and economical solution for pressure equalization of insulating glazings after their completion before or during further processing or construction-site use.

This object is accomplished in its device aspect by an insulating glazing with the features of claim 1 and in its method aspect by a production method with the features of claim 13. Expedient further developments of the inventive idea are the subject matter of the respective dependent claims.

The invention includes the idea of providing a pressure-equalizing element in the edge seal of the insulating glazing which is open, on the one hand, to the surrounding atmosphere and, on the other, to the interior of the spacer or to the glazing interior between the first and the second pane and is implemented such that it provides a temporally limited gas connection having a pressure-equalizing function between the atmosphere and the interior of the spacer or the interior of the glazing.

A further idea here is to realize the temporally limited gas connection by means of a substance or an active element in the pressure-equalizing element, which, due to aging and/or atmospheric influences drastically changes its gas permeability within a suitable period of time. At the same time, it must be ensured from the outset that the pressure-equalizing element does not jeopardize the water-tightness and extensive vapor-diffusion-tightness of the edge seal.

Here, the term "temporally limited gas connection having a pressure-equalizing function" should be understood to mean one that is effective to a significant extent only for a predetermined time after completion of the insulating glazing, i.e., in particular for a period of time typically extending from completion of the "pane package" until its incorporation into a window or a door or until its use in a façade glazing. This does not necessarily mean that no gas exchange at all and no further pressure equalization can occur at a later point in time, but rather that this is significantly reduced later.

Specifically, the pressure-equalizing element contains, in a main body, a water-tight active element made of an initially gas-permeable substance that ages and/or degenerates under the influence of humidity in the atmosphere and progressively reduces the gas permeability of the pressure-equalizing element until it is completely closed. In a simple embodiment, the aforementioned substance can be inserted into the main body as a membrane, based in particular on poly (-1-trimethylsilyl-1-propyne) (PTMSP).

In further embodiments, the degenerating substance can, on the one hand, be filled into the pressure-equalizing element together with, in particular on the outer side, a water-tight and gas-permeable membrane, which, however, retards the passage of water vapor, wherein in particular the degenerating substance is a polyethylene glycol (PEG) powder or granulate and the water-tight membrane is a PTFE membrane, in particular a stretched or sintered PTFE membrane (Goretex®, which is a layer of expanded polytetrafluoroethylene). In addition to those mentioned, other chemical substances or mixtures having a comparable function and justifiable costs can also be considered.

Another embodiment provides for the degenerating substance to be inserted into the pressure-equalizing element together with, in particular on the inner side, a water-tight and gas-permeable membrane, which, however, retards the passage of water vapor. Here, as well, the water-tight membrane has in particular a PTFE membrane, and the degenerating substance is a substance that swells under the influence of humidity, which substance is present as an insert that is initially porous or is provided with fine openings. A wide variety of such swellable substances are known, including in particular certain thermoplastic elastomers (TPEs).

In other embodiments, preferred for this reason, the glazing interior wall of the spacer is gas permeable, and the pressure-equalizing element protrudes into the interior of the spacer and connects it with the atmosphere in a pressure-equalizing manner.

Then, air or gas diffuses out of the interior of the spacer into the interpane space or into the atmosphere until the desired pressure equalization is achieved.

This embodiment is indicated in particular if the interior of the spacer is filled with a desiccant, because, then, ambient air entering during pressure equalization passes through the desiccant, and humidity is removed from it as desired. In particular, the glazing interior wall of the spacer can have a plurality of small openings, which are, in particular, distributed over the entire length of the spacer.

However, in principle, also possible is an embodiment wherein the pressure-equalizing element pierces the spacer and protrudes into the glazing interior and connects it to the atmosphere in a pressure-equalizing manner. In this case, a desiccant can be provided in the pressure-equalizing element itself, or, optionally, in certain applications, drying of the small amount of entering ambient air can be dispensed with.

In an expedient design, a main body section of the pressure-equalizing element can be embedded in the sealant strip and open on its outer side, and it is fixed to the outer wall of the spacer, e.g., screwed into it. In particular, the main body section embedded in the sealant strip is surrounded by a separate watertight seal and is provided with another separate water-vapor-tight seal is provided at the pierced opening in the outer wall of the spacer.

In another embodiment, the main body of the pressure-equalizing element essentially has a stepped cylindrical shape. A section with a larger diameter, referred to above as the "main body section", then sits on the outer wall of the spacer, and a section with a smaller diameter protrudes into the spacer through the opening provided there or pierces it at another opening in the glazing interior wall aligned with the first opening. In the cylindrical embodiment of the main body, the separate watertight seal has a hollow cylindrical or annular shape and the other separate water-vapor-tight seal is annular.

Method-related embodiments of the invention are readily apparent to the person skilled in the art from the aforementioned device-related aspects and are not described again here.

However, it should be noted that, optionally, the pressure-equalizing element is provided with the separate water-vapor-tight seal before insertion into the opening of the sealant strip. It is also noted that in another embodiment, the opening in the sealant strip is dimensioned larger than the outer dimensions of the pressure-equalizing element; and after insertion of the pressure-equalizing element, the gap between its outer contour and the inner wall of the opening is filled by injecting a sealing compound to form the separate water-tight seal. This enables hermetically sealed embedding of the pressure-equalizing element in the sealant strip regardless of its specific mechanical properties and production tolerances during creation of the opening for the pressure-equalizing element.

Figure 2:
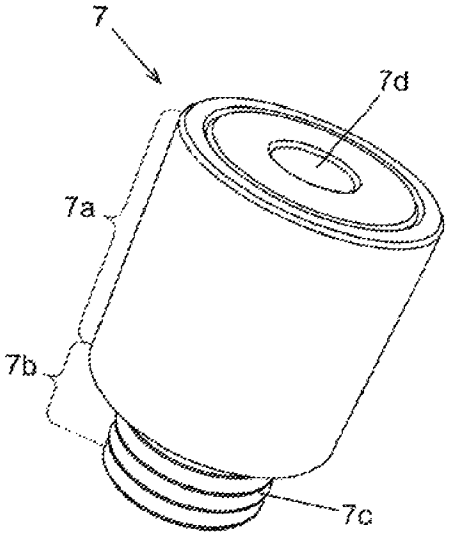
Figures 2A, 2B, 2C:
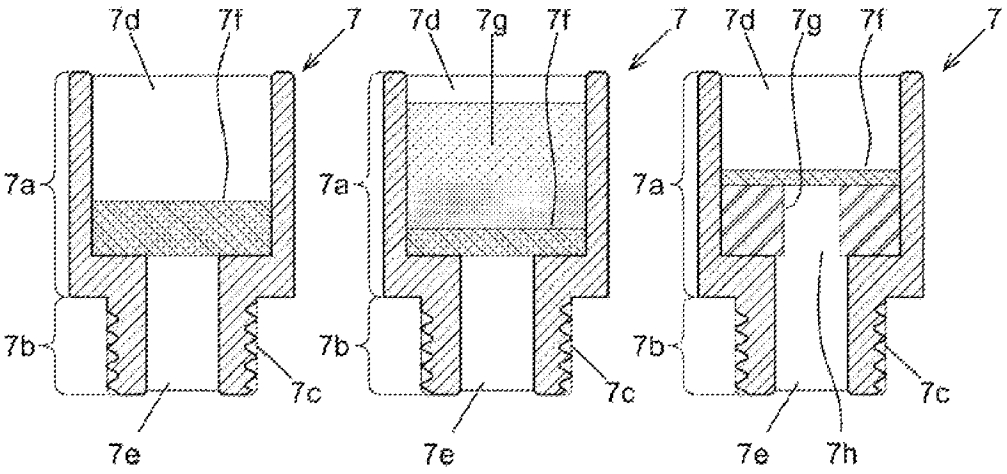

Advantages and functionalities of the invention are also apparent from the following description of an exemplary embodiment with reference to the figures. They depict:

FIG. 1 a perspective, partially sectional detailed view of a known insulating glazing, FIG. 2 a perspective view of a pressure-equalizing element for use in an insulating glazing according to the invention, FIG. 2A through 2C schematic sectional representations of embodiments of the pressure-relief element in embodiments of the insulating glazing according to the invention, and FIG. 3A through 3D schematic sectional views for illustrating manufacturing steps of an embodiment of the insulating glazing according to the invention.

FIG. 1 depicts, in a partially sectional, perspective view, an insulating glazing 1 comprising a first and second glass pane 2*a*, 2*b*, which are held at a distance from one another in a parallel position and with aligned edges by a spacer 2. The two pane contact surfaces 3*a*, 3*b* of the spacer 3 are provided with butyl strips 4*a*, 4*b*, realizing a vapor-diffusion-tight connection between the spacer 3 and the glass panes 2*a*, 2*b*. A sealant strip 5, pressed into the gap between the panes 2*a*, 2*b* by means of an applicator roll W outside the spacer 3, establishes a material, water-tight connection between the panes and completes the insulating glazing 1. The spacer 3, which has the cross-section of a rectangle and a trapezoid joined to one another on the long sides, is filled with beads of a desiccant 6 and has a glazing interior wall 3*c* provided with small openings 3*d*. The wall of the spacer 3 covered by the sealant strip 5 is referred to in the following as its outer wall 3*e*. The filling of the interior 3*f* of the spacer 3 with the desiccant 6, in conjunction with the openings 3*d*, ensures that any moisture penetrating into the glazing interior 2*c* is absorbed and cannot result in fogging of the panes.

FIG. 2 depicts a perspective exterior view of a pressure-equalizing element 7, which is intended for insertion into an insulating glazing 1 according to FIG. 1; and FIGS. 2A, 2B, and 2C depict exemplary design configurations of such a pressure-equalizing element.

Figure 3B:
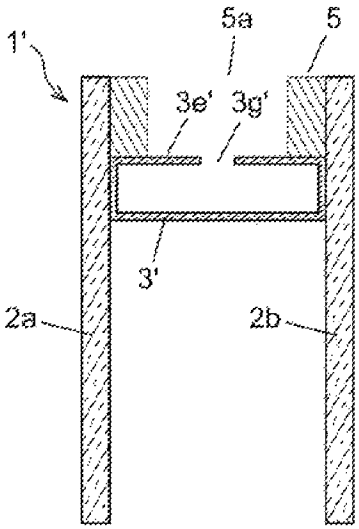

According to FIG. 2A, the pressure-equalizing element 7 has the basic shape of a stepped cylinder with a first main body section 7*a* with a larger diameter and a second main body section 7*b* with a smaller diameter, which is provided here with an outside thread 7*c* but can, however, also be plugged or clipped in. How such a pressure-equalizing element 7 is placed in the insulating glazing 1 is depicted in FIG. 3D and is described below. In addition to a first opening 7*d*, which can already be seen in FIG. 2, the pressure-equalizing element 7 has a second opening 7*e*, which can be seen in FIG. 2A.

FIG. 2A through 2C show possible design configurations of the pressure-equalizing element 7 with largely identical housing structure. The representations are to be understood as principle sketches and do not claim to depict all parts to be reasonably used to realize the respective function. It goes without saying that the housing structure and the basic shape of the housing can deviate from the representation given in FIG. 2 through 2C.

FIG. 2A depicts equipping of the pressure-equalizing element 7 with a membrane 7*f* that is ultra-permeable in the initial state but that, due to aging of the material, is converted in a predetermined period of time into a film that is vapor-diffusion-tight and also prevents gas exchange, made, for example, of poly(1-trimethylsilyl-1-propyne) (PTMSP) or a similar material. The exact composition, structure, and thickness of the membrane is selected as a function of the specific application, depending in particular on the period of time to be assumed from completion of the insulating glazing until its arrival at the final site of use, during which pressure equalization between the respective environment and the glazing interior should be possible.

FIG. 2B depicts, as another variant, a pressure-equalizing element 7, in which a vapor-diffusion-tight, but gas-permeable PTFE membrane 7*f* is placed at the bottom of the first main body section 7*a*; and, above this, a plastic material 7*g* that is initially readily permeable to gas, for example, a PEG powder, granulate, or molded body is poured or placed. With this, gas permeability is significantly reduced over time under the influence of atmospheric humidity. Depending on the intended use, this material can be selected in its chemical composition and form of introduction such that the reduction of gas permeability takes place over a predetermined period of time (see above) and, optionally, results in a completely gas-tight closure of the pressure-equalizing element.

FIG. 2C depicts, as another variant, a pressure-equalizing element 7, in which a water-tight PTFE membrane 7*f*, which retards the passage of water vapor, but is gas-permeable, and a molded body 7*g* made of a material that swells as a result of aging or under the influence of components of the ambient air (for example, humidity) are arranged one atop another. In the figure, the molded body 7*g* is depicted with a central through-opening 7*h*, which closes progressively due to swelling. The molded body can, however, also have multiple smaller through-openings or initially have relatively large pores that similarly decrease in size over time and possibly finally close completely. As with the aforementioned embodiments, the specific material and the design configuration of these components of the pressure-equalizing element are selected as a function of the specific intended use, in particular the desired time-dependent reduction in gas permeability.

FIG. 3A-3D depict, in sketch-type cross-sectional representations of an insulating glazing 1' according to the invention, essential steps of its production. The structure of the insulating glazing 1' corresponds largely to that of the insulating glazing 1 in FIG. 1, and corresponding or functionally similar parts are identified with the same reference numbers as there and not explained again here. FIG. 3A-3D depict a spacer 3' with a rectangular cross-section without desiccant filling; however, it can be assumed in the context of the present invention, that a spacer 3 with the geometric configuration and desiccant filling depicted in FIG. 1 is preferably used. It is also to be assumed that the spacer 3' can be provided with the butyl strip 4*a*, 4*b* depicted in FIG. 1.

Figure 3A:
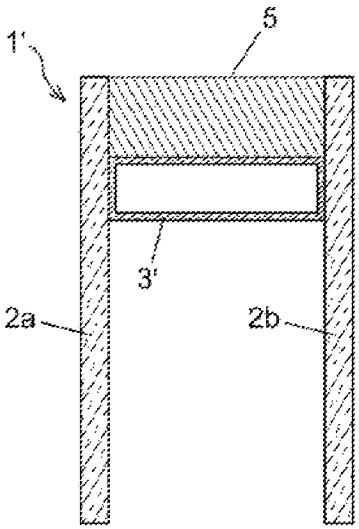
Figure 3D:
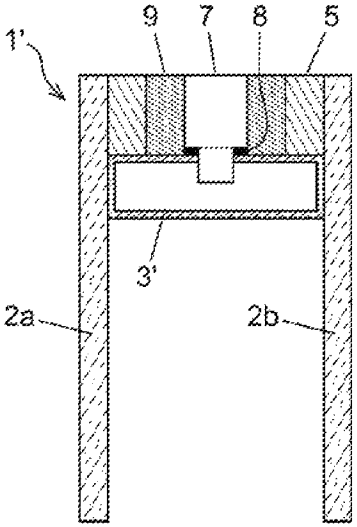

FIG. 3A depicts the insulating glazing 1' after completion of the edge seal by application of the sealant strip 5 and its curing. As can be seen in FIG. 3B, an opening 5*a* or 3*g'* adapted to the outer shape of a pressure-equalizing element to be inserted is made in the sealant strip 5 and in the outer wall 3*e'*, respectively. The opening 5*a* in the sealant strip 5 is dimensioned larger than the corresponding dimensions of the pressure-equalizing element, whereas the opening 3*g'* in the spacer 3' is adapted exactly to the corresponding dimensions of the pressure-equalizing element, for example, to screw a pressure-equalizing element provided, in sections, with a thread into the opening 3*g'*.

Figure 3C:
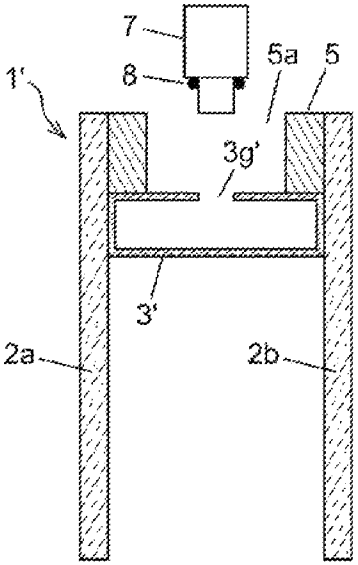

According to FIG. 3C, the pressure-equalizing element 7, provided with a butyl cord 8, is then brought to the location of the openings 5*a*, 3*g'* and inserted into the openings (for example, by screwing into the opening 3*g*) such that it is firmly seated there and the butyl cord 8 is elastically deformed such that it a vapor-diffusion seal at the opening 3*g'* of the spacer 3'. This state is depicted in FIG. 3D and it can also be seen there that a sealant ring 9 for the complete elastic filling of the opening 5*a* and for restoration of the watertight seal of the insulating glazing edge has been injected around the inserted pressure-equalizing element 7. This completes the production of the embodiment of the insulating glazing 1' depicted.

Moreover, the embodiment of the invention is also possible in a number of variations of the examples depicted here and aspects of the invention highlighted above.

LIST OF REFERENCE CHARACTERS

1, 1' insulating glazing
2*a*, 2*b* glass pane
2*c* glazing interior
3, 3' spacer
3*a*, 3*b* pane contact wall
3*c* glazing interior wall
3*d* small openings
3*e*, 3*e'* outer wall
3*f* interior of the spacer
3*g*, 3*g'* opening of the spacer
4*a*, 4*b* butyl strip
5 sealant strip
5*a* opening of the sealant strip
6 desiccant
7 pressure-equalizing element
7*a*, 7*b* main body section
7*c* thread
7*d*, 7*e* opening of the pressure-equalizing element
7*f* membrane
7*g* plastic granulate or plastic molded body
7*h* opening in the molded body
8 butyl cord
9 ring of sealing compound
W applicator roll

The invention claimed is:

1. An insulating glazing that comprises:
a first pane and a second pane,
a spacer between the first pane and the second pane that is fixedly connected to each of the first and second pane in a water-vapor-tight manner, which spacer has at least two parallel pane contact walls, an outer wall, a glazing interior wall and an interior, and a water-tight sealant strip running around the outer wall of the spacer between the first and second pane, wherein at least one pressure-equalizing element is inserted into the water-tight sealant strip and the spacer, which least one pressure-equalizing element is open to a surrounding atmosphere and to the interior of the spacer or to a glazing interior between the first and the second pane and is implemented such that the least one pressure-equalizing element provides a gas connection having a pressure-equalizing function between the surrounding atmosphere and the interior of the spacer or the glazing interior, wherein the least one pressure-equalizing element contains, in a main body, an initially gas-permeable substance, which ages and/or degenerates under an influence of humidity in the surrounding atmosphere and progressively reduces a gas permeability of the least one pressure-equalizing element until complete closure of the at least one pressure-equalizing element, wherein the initially gas-permeable substance together with a water-tight and gas-permeable membrane which retards a passage of water vapor is filled into the least one pressure-equalizing element.

2. The insulating glazing according to claim 1, wherein the initially gas-permeable substance is a polyethylene glycol powder or granulate and the water-tight and gas-permeable membrane is a PTFE membrane.

3. The insulating glazing according to claim 2, wherein the initially gas-permeable substance is a stretched or sintered PTFE membrane.

4. The insulating glazing according to claim 1, wherein the water-tight and gas-permeable membrane is based on PTMSP.

5. The insulating glazing according to claim 1, wherein the water-tight membrane and gas-permeable is a PTFE membrane, and the initially gas-permeable substance is a substance that swells under the influence of humidity, which is present as an insert that is initially porous or is provided with openings.

6. The insulating glazing according to claim 1, wherein the glazing interior wall of the spacer is gas permeable and the least one pressure-equalizing element protrudes into the interior of the spacer and connects the interior to the surrounding atmosphere in a pressure-equalizing manner.

7. The insulating glazing according to claim 5, wherein the glazing interior wall of the spacer has a plurality of openings that are distributed over an entire length of the spacer, and the interior of the spacer is filled with a desiccant.

8. The insulating glazing according to claim 1, wherein the least one pressure-equalizing element pierces the spacer and protrudes into the glazing interior and connects the glazing interior to the surrounding atmosphere in a pressure-equalizing manner.

9. The insulating glazing according to claim 1, wherein a main body section of the least one pressure-equalizing element is embedded in the water-tight sealant strip and is open on an outer side of the water-tight sealant strip and is fixed to the outer wall of the spacer.

10. The insulating glazing according to claim 9, wherein the main body section embedded in the water-tight sealant strip is surrounded by a separate water-tight seal and is provided at a pierced opening in the outer wall of the spacer with another separate water-vapor-tight seal.

11. The insulating glazing according to claim 1, wherein the main body of the least one pressure-equalizing element has a stepped cylindrical shape.

12. The insulating glazing according to claim 10, wherein the separate water-tight seal has a hollow cylindrical or annular shape and the another separate water-vapor-tight seal is annular.

13. A method for producing an insulating glazing according to claim 1, comprising:

forming the insulating glazing by parallel arrangement of the first and second panes and connecting the first and second panes in a water-vapor-tight manner to the first and second pane contact wall of the spacer, respectively, applying the water-tight sealant strip circumferentially on the outer wall of the spacer, forming an opening at at least one point of the water-tight sealant strip and at least in the outer wall of the spacer, gas-tightly inserting the/each least one pressure-equalizing element, which contains, in the main body, the initially gas-permeable substance that ages and/or degenerates under the influence of humidity in the surrounding atmosphere and progressively reduces the gas permeability of the least one pressure-equalizing element until complete closure of the at least one pressure-equalizing element, into the opening in the water-tight sealant strip and the outer wall of the spacer.

14. The method according to claim 13, wherein the least one pressure-equalizing element is provided with a separate water-vapor-tight seal before insertion into the opening of the water-tight sealant strip.

15. The method according to claim 13, wherein the opening in the water-tight sealant strip is dimensioned larger than outer dimensions of the least one pressure-equalizing element, and after insertion of the least one pressure-equalizing element, a gap between an outer contour of the least one pressure-equalizing element and an inner wall of the opening is filled by injecting a sealing compound to form the separate water-tight seal.

* * * * *